US008276328B2

(12) United States Patent
Pépin

(10) Patent No.: US 8,276,328 B2
(45) Date of Patent: Oct. 2, 2012

(54) WALL MODULE, HOUSING MODULE AND BUILDING MADE OF SUCH WALL MODULE

(75) Inventor: Guy Pépin, Sherbrooke (CA)

(73) Assignee: Technostructur Inc., Sherbrooke, Québec (CA)

( * ) Notice: Subject to any disclaimer, the term of this patent is extended or adjusted under 35 U.S.C. 154(b) by 227 days.

(21) Appl. No.: 12/777,637

(22) Filed: May 11, 2010

(65) Prior Publication Data

US 2010/0287848 A1 Nov. 18, 2010

(51) Int. Cl.
*E04C 3/02* (2006.01)
*E04C 9/02* (2006.01)

(52) U.S. Cl. ..... 52/167.3; 52/693; 52/657; 52/695

(58) Field of Classification Search ..... 52/79.12, 52/79.1, 657, 695, 656.9, 693, 481.1, 79.9, 52/295, 638, 696

See application file for complete search history.

(56) References Cited

U.S. PATENT DOCUMENTS

| | | | | | |
|---|---|---|---|---|---|
| 390,732 | A | * | 10/1888 | Weston | 52/695 |
| 2,073,889 | A | * | 3/1937 | Trout | 52/282.4 |
| 2,076,728 | A | * | 4/1937 | Keller | 52/210 |
| 2,191,804 | A | * | 2/1940 | Omalley | 52/407.3 |
| 2,302,101 | A | | 11/1942 | Boydstun | |
| 3,638,380 | A | * | 2/1972 | Perri | 52/79.12 |
| 4,001,990 | A | | 1/1977 | Chase et al. | |
| 4,235,054 | A | | 11/1980 | Cable et al. | |
| 4,488,390 | A | * | 12/1984 | Mulford | 52/407.1 |
| 4,563,851 | A | * | 1/1986 | Long | 52/656.1 |
| 4,914,879 | A | | 4/1990 | Goldberg | |
| 5,170,600 | A | | 12/1992 | Terrell | |
| 5,209,030 | A | | 5/1993 | Sloditskie et al. | |
| 5,333,426 | A | * | 8/1994 | Varoglu | 52/236.7 |
| 5,447,000 | A | * | 9/1995 | Larsen | 52/79.1 |
| 5,657,606 | A | | 8/1997 | Ressel et al. | |
| 5,729,950 | A | * | 3/1998 | Hardy | 52/693 |
| 5,953,883 | A | * | 9/1999 | Ojala | 52/794.1 |
| 6,006,480 | A | | 12/1999 | Rook | |
| 6,067,769 | A | * | 5/2000 | Hardy | 52/693 |
| 6,240,695 | B1 | * | 6/2001 | Karalic et al. | 52/690 |
| 6,279,284 | B1 | * | 8/2001 | Moras | 52/408 |
| 6,463,705 | B1 | * | 10/2002 | Davis et al. | 52/143 |
| 6,493,996 | B1 | | 12/2002 | Alexander et al. | |
| 6,634,153 | B1 | * | 10/2003 | Peterson | 52/695 |

(Continued)

FOREIGN PATENT DOCUMENTS

| | | |
|---|---|---|
| CA | 514195 | 6/1955 |

(Continued)

*Primary Examiner* — Phi Dieu Tran A

(74) *Attorney, Agent, or Firm* — France Côté; Benoît & Côté, Associés Inc.

(57) ABSTRACT

A wall module for the construction of a housing module comprises two beams, two primary studs, two bracing members, primary reinforcements and a plurality of secondary studs. The two beams are spaced apart and substantially parallel to each other. The two primary studs are perpendicularly connected between different extremities of the two beams so as to define four wall corners. The two bracing members are connected substantially diagonally between two different opposed wall corners. The primary reinforcements are located at the wall corners and are connect one of the two beams to one of the two primary studs and to one of the bracing members. The secondary studs are attached to the two beams and to at least one of the two bracing members. The wall module may further comprise a sheathing attached to the secondary studs and a finishing sheet attached to the sheathing in between the secondary studs.

18 Claims, 6 Drawing Sheets

U.S. PATENT DOCUMENTS

| | | | | |
|---|---|---|---|---|
| 6,941,718 | B1 * | 9/2005 | diGirolamo et al. | 52/695 |
| 7,155,865 | B2 | 1/2007 | Rosenberg | |
| 7,231,742 | B2 * | 6/2007 | Majlessi | 52/167.3 |
| 7,891,152 | B2 * | 2/2011 | Yu | 52/657 |
| 2009/0211194 | A1 * | 8/2009 | Fyfe et al. | 52/657 |

FOREIGN PATENT DOCUMENTS

| | | |
|---|---|---|
| CA | 1069272 | 1/1980 |
| CA | 1115505 | 1/1982 |
| CA | 1178766 | 12/1984 |
| CA | 2075188 | 8/1991 |
| CA | 1322093 | 9/1993 |
| CA | 2119296 | 2/1996 |
| CA | 2300637 | 9/2000 |
| CA | 2227572 | 1/2002 |
| CA | 2381526 | 10/2002 |
| CA | 2386116 | 4/2003 |
| CA | 2434365 | 12/2004 |
| CA | 2395279 | 8/2006 |
| CA | 2601590 | 9/2006 |
| CA | 2435536 | 11/2006 |
| CA | 2531424 | 6/2007 |
| CA | 2589443 | 11/2007 |
| CA | 2605031 | 4/2008 |
| CA | 2678586 | 8/2008 |

* cited by examiner

WALL MODULE, HOUSING MODULE AND BUILDING MADE OF SUCH WALL MODULE

BACKGROUND (a) Field

The present invention generally relates to the field of buildings. More specifically, the invention relates to a wall module for making housing modules that can be transported on site and assembled into a building.

(b) Related Prior Art

Contrarily to most products, houses and other buildings are typically not built in a manufacturing plant, but are built directly on the land where they will be located. In other words, the "manufacturing plant" needs to be moved to the future location of a building. Notwithstanding environmental conditions that may affect both the materials and the labor used for the construction, government regulated construction workers compensation enormously increase the labor portion of the construction costs. Moreover, if a house or building needs to be built in a remote location, labor cost is even higher because construction workers have to travel to the construction site.

As a solution for these high on-site labor costs, many manufacturers have started manufacturing houses and small buildings in a production plant. Whether built in large or in small modules (as small as a wall portion or as large as a whole house), these manufactured houses and buildings modules are transported on site where their final assembly and finishing takes place. Although it may be desirable to manufacture as large housing modules as possible, the difficulty lies with the transportation of such large modules. Indeed, during transportation, the modules are subject to deformation, due to vibrations or to the own deformation of the carrier means. These deformations and vibrations prevent the completion of the interior finishing of the house or building since wall and molding joints crack, windows are subject to breakage and cabinet panels chafe against each other. Consequently, it is typical that in-plant manufactured housing modules do not comprise their interior finishing, which has to be done on site and which is therefore more expensive.

There is therefore a need for a structure for a housing module that allows an increased number of operations to be completed in a manufacturing plant before shipping of the housing module on site.

SUMMARY

In a first embodiment there is disclosed a wall module for the construction of a housing module having:

two beams that may be spaced apart and substantially parallel to each other;

two primary studs that may be substantially perpendicularly connected between different extremities of the two beams so as to define four wall corners;

two bracing members that may be directly coupled together and continuously connected substantially diagonally between two different opposed wall corners;

primary reinforcements that may be located at the wall corners, the primary reinforcements rigidly connecting one of the two beams to one of the two primary studs and to one of the two bracing members; and a plurality of secondary studs that may be attached to the two beams and to at least one of the two bracing members.

In a second embodiment there is disclosed a housing module having:

a floor;

an exterior shell that may be resting on the floor, the exterior shell may be made of a plurality of wall modules having:

two beams that may be spaced apart and substantially parallel to each other;

two primary studs that may be substantially perpendicularly connected between different extremities of said two beams so as to define four wall corners;

two bracing members that may be directly coupled together and continuously connected substantially diagonally between two different opposed wall corners;

primary reinforcements that may be located at the wall corners, the primary reinforcements rigidly connecting one of the two beams to one of the two primary studs and to one of the two bracing members; and a plurality of secondary studs that may be attached to the two beams and to at least one of the two bracing members.

It is an object of the present invention to provide a wall module for housing modules that overcomes or mitigates one or more disadvantages of known modular housing constructions, or at least provides a useful alternative.

The invention provides the advantages of making possible the assembly of housing modules that are cheaper to manufacture than on-site construction.

The invention allows the production of housing modules that may be transported by road or rail to remote locations.

In accordance with an embodiment of the present invention, there is provided a wall module for the construction of a housing module. The wall module comprises two beams, two primary studs, two bracing members, primary reinforcements and a plurality of secondary studs. The two beams are spaced apart and substantially parallel to each other. The two primary studs are substantially perpendicularly connected between different extremities of the two beams so as to define four wall corners. The two bracing members are connected substantially diagonally between two different opposed wall corners. The primary reinforcements are located at the wall corners and are rigidly connecting one of the two beams to one of the two primary studs and to one of the bracing members. The secondary studs are attached to the two beams and to at least one of the two bracing members.

Optionally, the wall module may further comprise a sheathing attached to the secondary studs and a finishing sheet attached to the sheathing, the finishing sheet being attached in between the secondary studs.

In accordance with another embodiment of the present invention, there is provided a housing module. The housing module comprises a floor and an exterior shell resting on the floor. The shell is made of many wall modules as previously defined.

In accordance with yet another embodiment of the present invention, there is provided a building made of a plurality of adjacent housing modules.

BRIEF DESCRIPTION OF THE DRAWINGS

These and other features of the present invention will become more apparent from the following description in which reference is made to the appended drawings wherein.

DETAILED DESCRIPTION OF THE INVENTION

The present invention relates to a wall construction for a housing module and to the housing module itself. The wall construction actually allows the housing module to be transported by transportation means without sustaining any damages. The housing module can be in a finished state, including electrical wiring, plumbing, finished wall, paint, floor covering, cabinetry etc.

Figure 1:
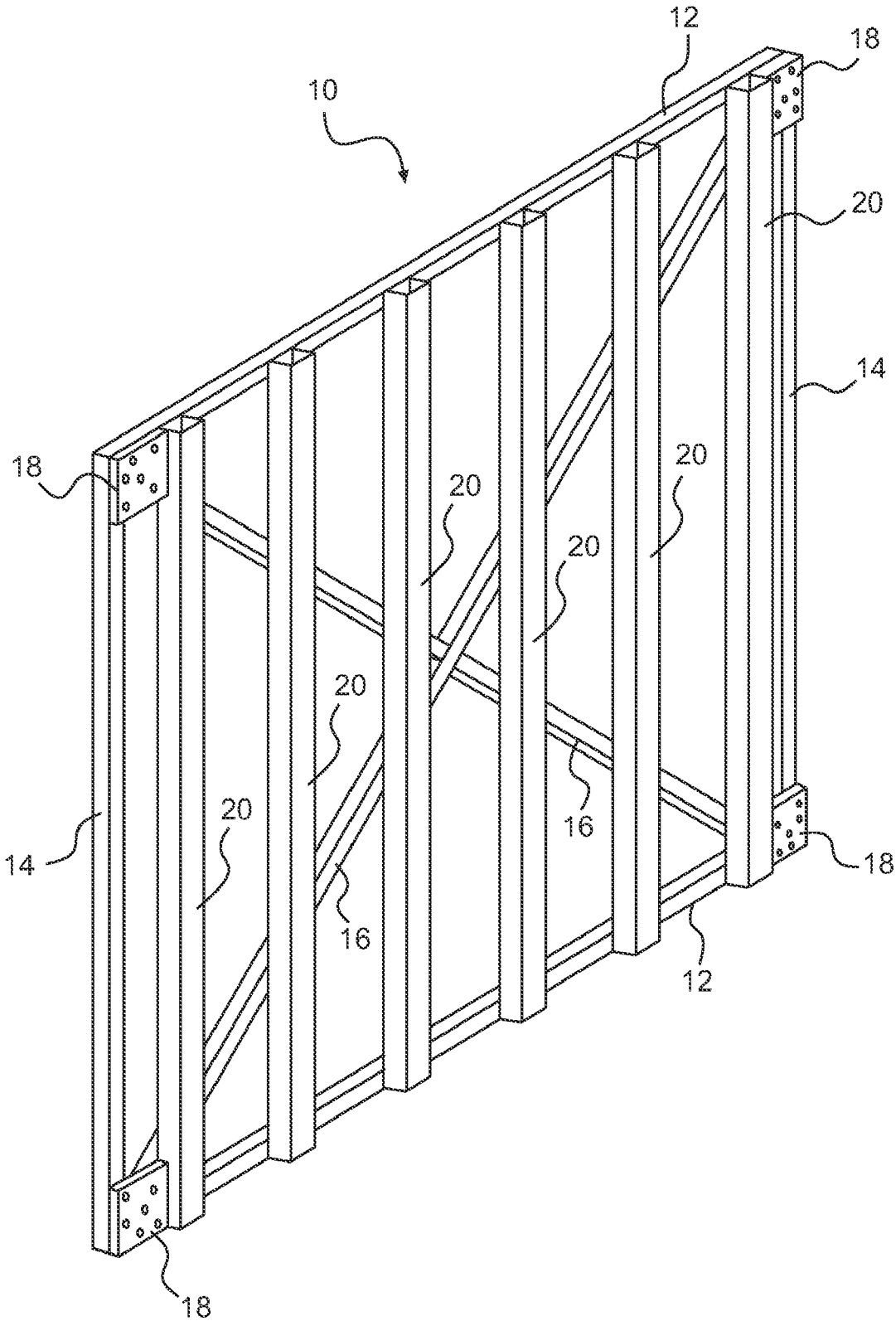
FIG. 1 shows an axonometric view of a wall module in accordance with an embodiment of the present invention.
Figure 2:
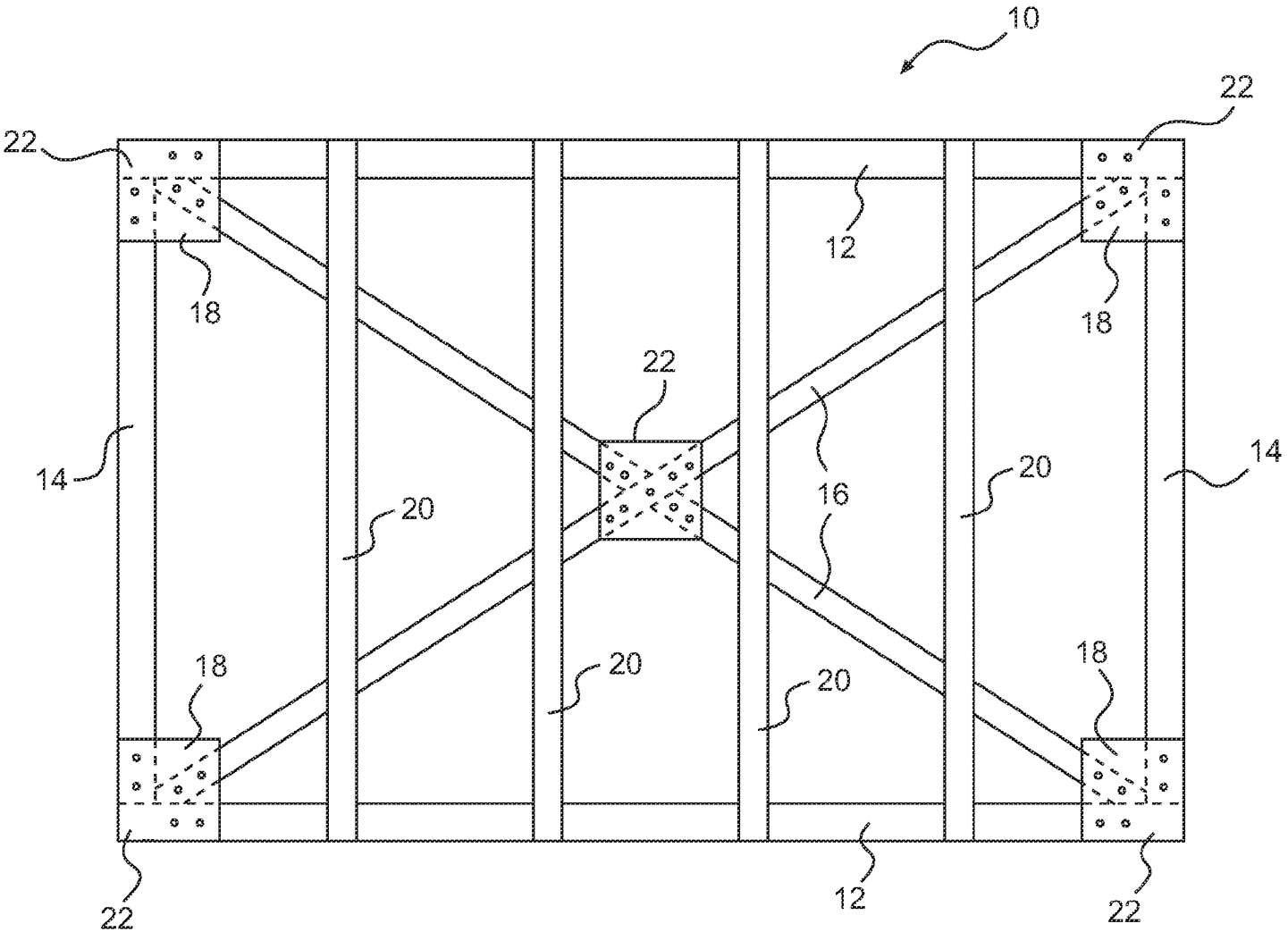
FIG. 2 is a front view of the wall module of FIG. 1.

FIGS. 1 and 2, concurrently referred to, show a wall module 10 for the construction of a building. The wall module 10 comprises two beams 12, two primary studs 14, two bracing members 16, primary reinforcements 18 and a plurality of secondary studs 20. The two beams 12 are spaced apart and are substantially parallel to each other. One of the beams 12 is adapted to contact a floor while the other beam 12 is adapted to receive a roof, as will be discussed below. The two primary studs 14 are substantially perpendicularly connected between different extremities of the two beams 12. Thereby, they define four wall corners 22.

The two bracing members 16 are connected substantially diagonally between two different opposed wall corners 22. These bracing members 16 add rigidity to the wall module 10 when this latter is loaded in shear.

The primary reinforcements 18 are located at the wall corners 18 and rigidly connect one beam 12 to one primary stud 14 and to one bracing member 16. The primary reinforcements 18 may take the form of metal reinforcing plates.

As is best shown in FIG. 2, a secondary reinforcement 22 may be used to further reinforce the wall module 10. The secondary reinforcement 22 is attached to both bracing members 16 where they cross each other. The secondary reinforcement 22 may also take the form of a metal reinforcing plate.

The secondary studs 20 are attached to the two beams 12 and to at least one of the two bracing member 16.

The wall module 10 may use different materials and its components may take different shapes. For example, the wall module 10 may be made of wood, with typical timbers of 2×4s or 2×6s used as the beams 12, primary and secondary studs 14, 20 and bracing members 16. The primary and secondary reinforcing plates 18, 22 may be made of plywood, for example.

Alternatively, the wall module 10 may be constructed of a metallic material, such as steel or aluminum. For example, it was found that steel provided very good performance. Each component may take different shapes or cross-sections. For example, it was found that having the wall module 10 made of steel and having the beams 12 made of an open cross-section (such as an "I" beam, for example), and both the primary studs 14 and the bracing members 16 made of a closed cross-section such as a tube provided very good performance.

Figure 3:
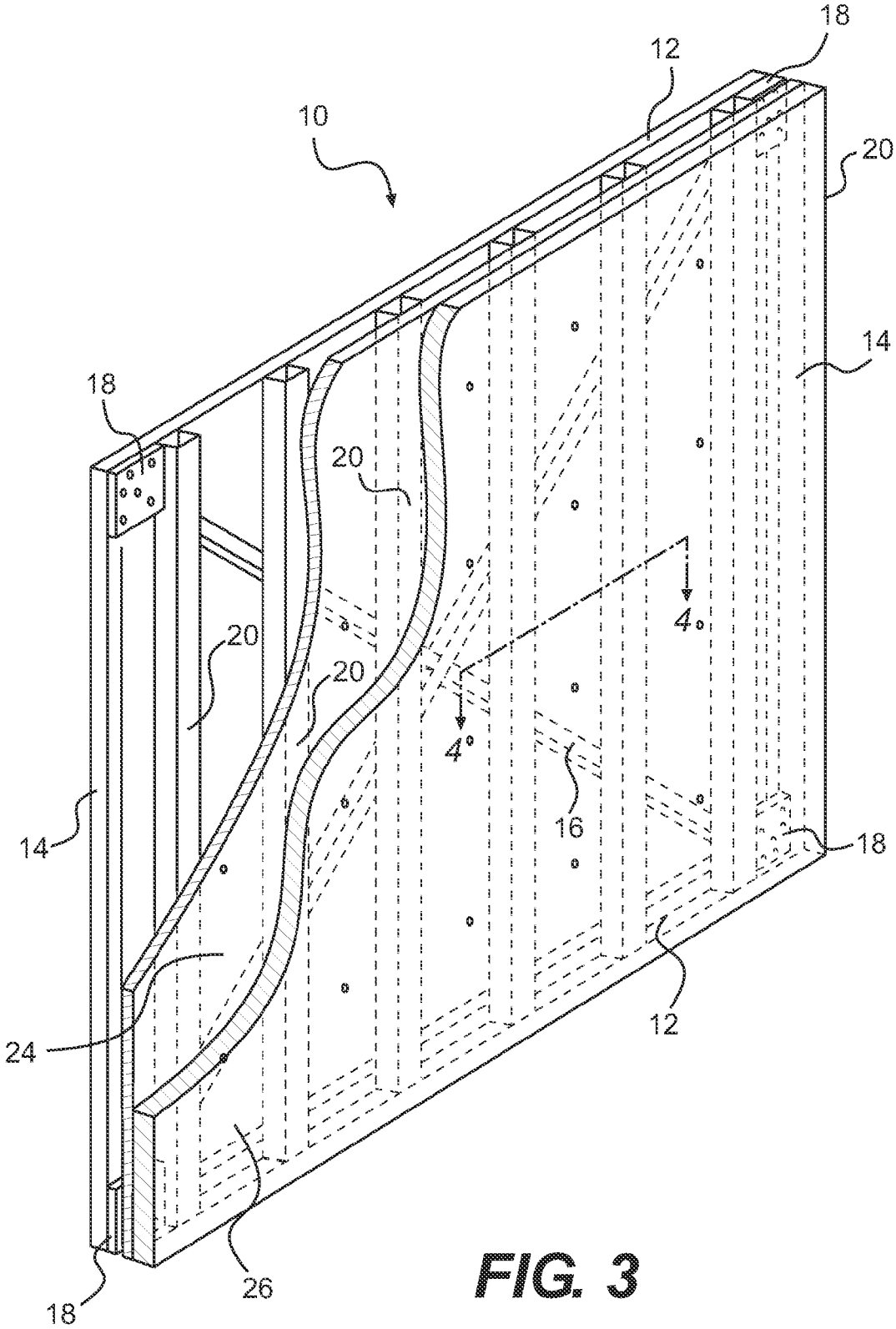
FIG. 3 is a partially cut-away axonometric view of a wall module in accordance with another embodiment of the present invention.

FIG. 3 is now referred to. In this figure the wall module 10 of FIG. 1 further comprises a sheathing 24 attached to the secondary studs 20. The sheathing 24 may be plywood or any other suitable structural material that adds rigidity to the wall module 10 and that is capable of supporting a finishing sheet 26 which is used to provide a pleasant appearance to the wall module 10. The finishing sheet 26 may be drywall for example.

Figure 4:
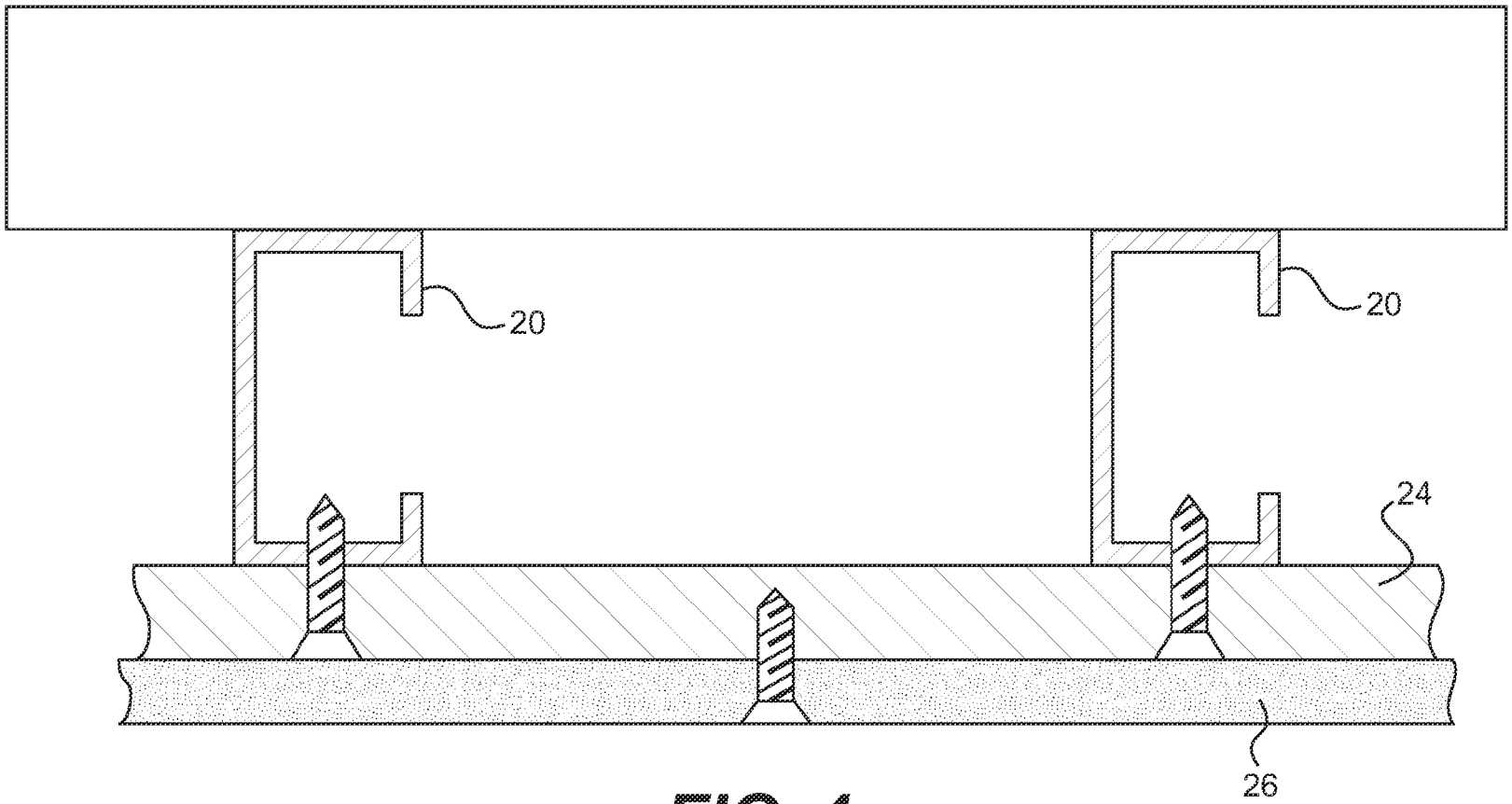
FIG. 4 is a cross-section of a portion of the wall module of FIG. 3.

Advantageously, the finishing sheet 26 is fixed to the sheathing 24 between the secondary studs 20, as may be better seen in FIG. 4, now concurrently referred to. Indeed, such an arrangement proved to better resist small deformations during transportation of a housing module made from an assembly of many wall modules 10. By attaching the finishing sheet 26 to the sheathing 24 using screws, or any other adequate fixation means such as nails or staples, placed in between the secondary studs 20 so that the finishing sheet 26 is never attached directly to the secondary studs 20, it was found that plaster joints between finishing sheets 26 made of drywall did not crack during transportation.

Figure 5:
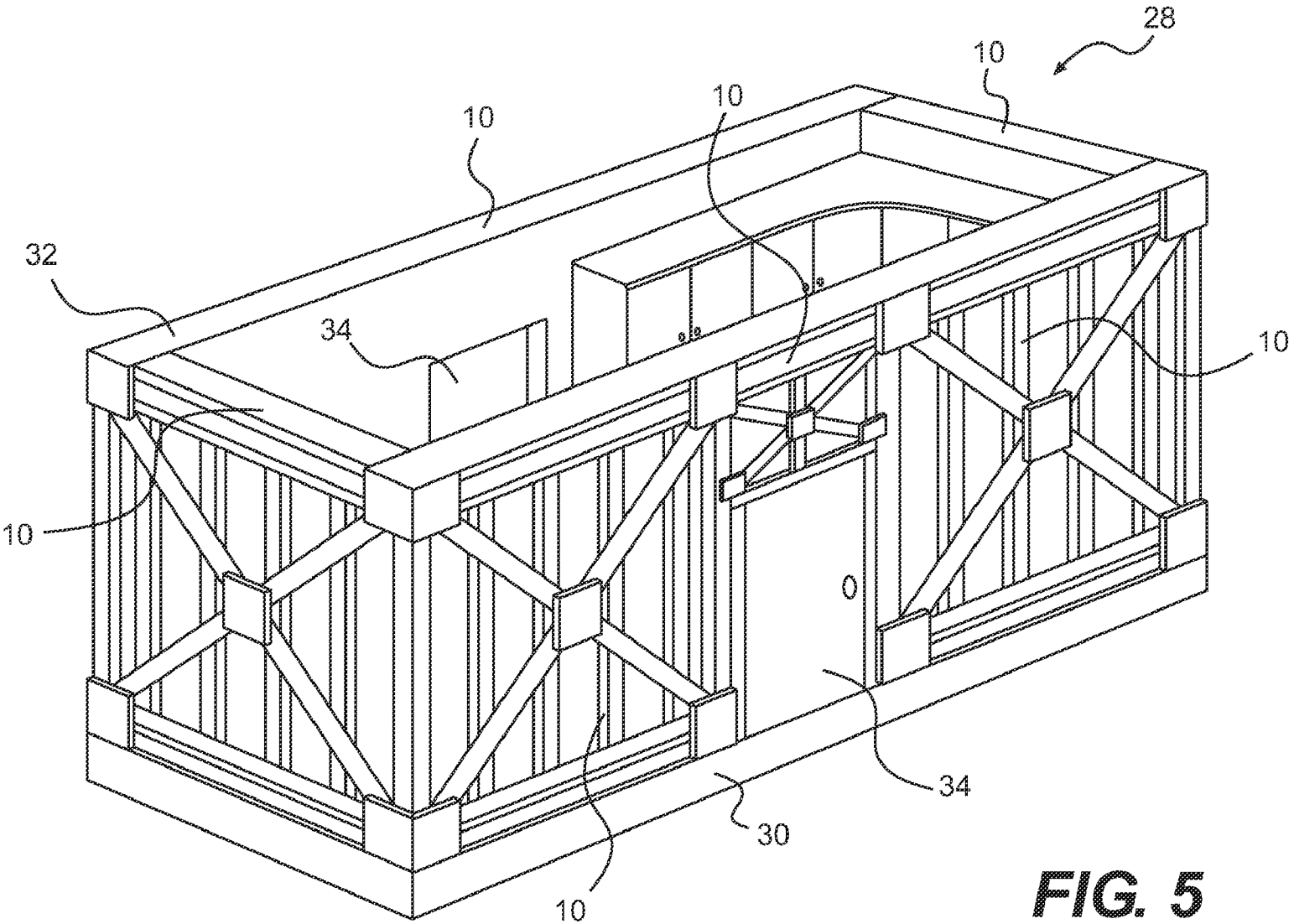
FIG. 5 is an axonometric view of a housing module made of a plurality of wall modules as shown in FIG. 3.

FIG. 5 depicts another embodiment of the present invention where a housing module 28 is built from the assembly of many wall modules 10. Indeed, the housing module 28 comprises a floor 30 and an exterior shell 32 resting on the floor 30. The exterior shell 32 is made of a plurality of wall modules 10. The exterior shell 32 of the housing module 28 may be made of any embodiment of the wall module 10, and more likely, the embodiment of the wall module 10 comprising the sheathing 24 and the finishing sheet 26. As is shown, each straight portion of the exterior shell 32 may be made of more than one wall module 10. Moreover, the exterior shell 32 may comprise wall modules 10 that are of different size to accommodate openings 34 such as windows and doors. In fact, the exterior shell 32 may comprise curved portions, which may also be made of one or more curved wall modules 10.

The advantage of using the wall module 10 for the exterior shell 32 of the housing module 28 in combination with the floor 30 is that it makes for a structure that is very stiff and resistant to stresses caused by the transportation of the housing module 28. Because its structure is stiff, the housing module 28 may be shipped mostly completed, with its interior finished, including cabinetry, plumbing, electricity, flooring (wood flooring, tiles, etc), moldings, windows, doors, interior walls, etc. Moreover, because the finishing sheets 26 are not attached directly to the secondary studs 20 but rather through the sheathing 24, their joints may be plastered and they can be painted without risk of cracking. This is advantageous as the housing module 28 may be shipped complete, except for the exterior finishing (such as brick, stone, etc).

The floor 30 is typically made of concrete. However, the floor 30 could also be made of another wall module 10.

Figure 6:
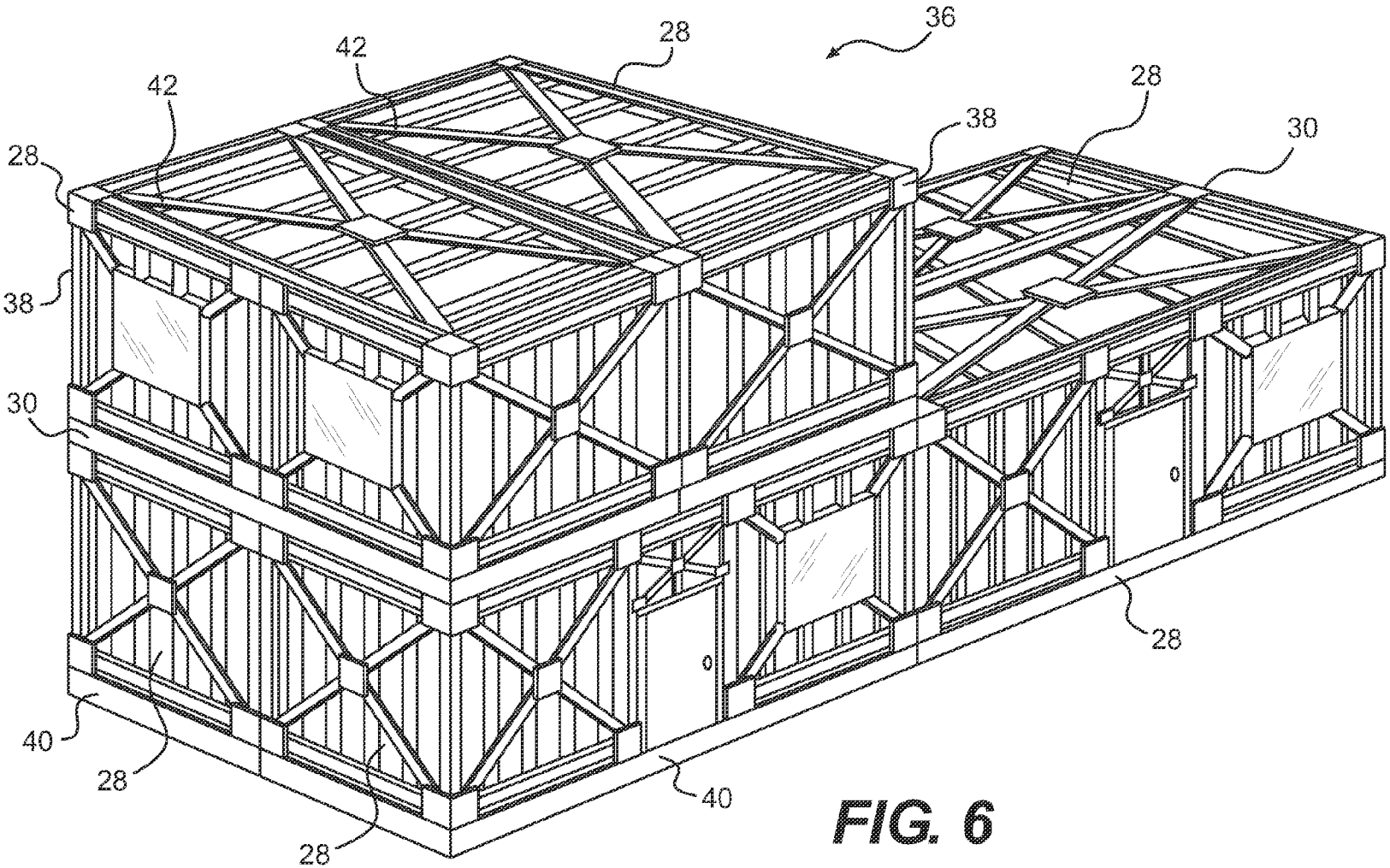
FIG. 6 is an axonometric view of a building made with a plurality of housing modules as shown in FIG. 5.

Many housing modules 28 may be assembled together to create a building 36, as is shown in FIG. 6, now concurrently referred to. As is shown, the housing modules 28 may be juxtaposed, either beside each other, atop each other or a combination of both. When the housing modules 28 are placed atop each other, it may be advantageous not to provide the housing modules 28 placed underneath with a roof as the floor 30 of an upper housing module 38 combines to create a ceiling of a lower housing module 40 placed underneath. However, the upper housing module 36 needs to be provided with a roof. Hence, the housing module 28 may optionally be provided with such a roof 42, which may also be made of any embodiment of the wall module 10.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description. The invention is defined by the claims that follow.

I claim:

1. A wall module for the construction of a housing module, the wall module comprising:

two beams, said two beams being spaced apart and substantially parallel to each other;

two primary studs, said two primary studs being substantially perpendicularly connected between different extremities of said two beams so as to define four wall corners;

two continuous bracing members, said two bracing members being directly coupled together and being continuously connected substantially diagonally between, and directly contacting two different opposed wall corners;

primary reinforcements, said primary reinforcements being located at said wall corners, said primary reinforcements rigidly connecting one of said two beams to one of said two primary studs and to one of said two bracing members;

a plurality of secondary studs, provided between said primary studs, said secondary studs being attached to said two beams and to at least one of said two bracing members; and a secondary reinforcement, said secondary reinforcement being attached to each of said two bracing members where said bracing members cross each other, said secondary reinforcement comprising a reinforcing plate.

2. The wall module of claim 1 further comprising a sheathing, said sheathing being attached to said secondary studs.

3. The wall module of claim 2 further comprising a finishing sheet, said finishing sheet being attached to said sheathing.

4. The wall module of claim 3 wherein said finishing sheet is attached to said sheathing in between said secondary studs.

5. The wall module of claim 1 wherein said sheathing is a sheet of plywood and said finishing sheet is a sheet of drywall.

6. The wall module of claim 1 wherein said primary reinforcements are reinforcing plates.

7. The wall module of claim 1 wherein each one of said two bracing members has a closed cross-section.

8. The wall module of claim 1 wherein said two beams have an opened cross-section.

9. The wall module of claim 1 wherein said two beams, said two primary studs, said two bracing members, said primary reinforcements, said secondary reinforcement and said plurality of secondary studs are made of steel.

10. A housing module comprising:

a floor;

an exterior shell, said exterior shell resting on said floor, said exterior shell being made of a plurality of wall modules comprising:

two beams, said two beams being spaced apart and substantially parallel to each other;

two primary studs, said two primary studs being substantially perpendicularly connected between different extremities of said two beams so as to define four wall corners;

two continuous bracing members, said two bracing members being directly coupled together and continuously connected substantially diagonally between, and directly contacting two different opposed wall corners;

primary reinforcements, said primary reinforcements being located at said wall corners, said primary reinforcements rigidly connecting one of said two beams to one of said two primary studs and to one of said two bracing members;

a plurality of secondary studs, provided between said primary studs, said secondary studs being attached to said two beams and to at least one of said two bracing members, and a secondary reinforcement, said secondary reinforcement being attached to each of said two bracing members where said bracing members cross each other, said secondary reinforcement comprising a reinforcing plate.

11. The housing module of claim 10 further comprising a roof, said roof resting on said exterior shell, said roof being made of said wall module.

12. The housing module of claim 10 wherein said floor is made of concrete.

13. The housing module of claim 10 further comprising tiles attached to said floor.

14. The housing module of claim 10 further comprising plumbing within said plurality of said wall modules.

15. The housing module of claim 10 further comprising cabinets attached to at least one of said plurality of said wall modules.

16. The housing module of claim 10 further comprising electrical wires within said wall modules.

17. A building made of a plurality of adjacent housing modules as defined in claim 10.

18. The building of claim 16 wherein at least two of said housing modules are placed atop each other.

* * * * *